US005115974A

United States Patent [19]

Tobias et al.

[11] Patent Number: 5,115,974

[45] Date of Patent: May 26, 1992

[54] APPARATUS FOR PROVIDING A WATERFALL OR A FOUNTAIN

[75] Inventors: Samuel Tobias, Edison, N.J.; Fred Hollinger, Kings Park, N.Y.

[73] Assignee: Hayward Industries, Inc., Elizabeth, N.J.

[21] Appl. No.: 748,236

[22] Filed: Aug. 21, 1991

[51] Int. Cl.[5] ..... B05B 17/08

[52] U.S. Cl. ..... 239/23; 239/193; 239/289; 4/496; 4/492; 4/541.6; 4/678

[58] Field of Search ..... 239/16, 17, 20, 22, 239/23, 193, 200, 289, 566, 587; 4/191, 192, 492, 494, 496; 137/801

[56] References Cited

U.S. PATENT DOCUMENTS

| | | | |
|---|---|---|---|
| 2,225,836 | 12/1940 | Lund | 239/193 |
| 3,030,028 | 4/1962 | Hruby, Jr. . | |
| 3,318,528 | 5/1967 | Williams | 239/17 |
| 3,722,816 | 3/1973 | Stewart et al. . | |
| 3,831,852 | 8/1974 | Stillman, Jr. | 239/201 |
| 3,941,154 | 3/1976 | Bishop | 239/17 |
| 4,174,808 | 11/1979 | Latin | 239/23 |
| 4,334,328 | 6/1982 | Delepine | 4/191 |
| 4,416,420 | 11/1983 | Thompson . | |
| 4,513,458 | 4/1985 | Delepine | 4/191 |
| 4,590,628 | 5/1986 | DeGregorio | 4/191 |
| 4,630,771 | 12/1986 | Hall . | |
| 4,852,190 | 8/1989 | Jacuzzi et al. | 4/191 |
| 4,881,280 | 11/1989 | Lesikar | 239/20 |
| 4,912,782 | 4/1990 | Robbins | 239/520 |
| 4,936,506 | 6/1990 | Ryan | 239/23 |

OTHER PUBLICATIONS

"Wonderfall" publication by Dunn-Rite (undated).

"Aquaflower" publication by American Fountain Company, Inc. (undated).

*Primary Examiner*—Andres Kashnikow

*Assistant Examiner*—Karen B. Merritt

*Attorney, Agent, or Firm*—Ralph W. Selitto, Jr.

[57] ABSTRACT

A device for creating a waterfall effect and a fountain effect in an adjacent swimming pool spa or the like, has a tubular manifold with spray orifices which produce streams of water. The manifold is positionable so that the streams of water can be aimed away from the housing at an inclined angle, thereby producing a fountain effect, or so that the streams of water can be directed to fill a reservoir located within the housing and adapted to discharge water in the form of a waterfall.

33 Claims, 8 Drawing Sheets

102

88
82
62
100
10
90
14
60
68
52
7
7
66
64
86
44
84
50
80
42
40
24
18

APPARATUS FOR PROVIDING A WATERFALL OR A FOUNTAIN

FIELD OF THE INVENTION

The present invention relates to an apparatus for producing a fountain or a waterfall in a body of water, such as a swimming pool, spa or the like.

BACKGROUND OF THE INVENTION

Waterfalls and fountains have been in existence for centuries in countless different variations and forms. The enduring popularity of both waterfalls and fountains can be attributed to their numerous aesthetic and practical applications, making them desirable for artistic, recreational and commercial uses.

Few applications derive more benefit from waterfalls and fountains than do recreational swimming pools. When used in swimming pools, waterfalls and fountains have a great aesthetic value, make pleasant sounds, add oxygen to the pool water, mix chemicals in the water and regulate the temperature of the water.

In the swimming pool field, devices have been proposed which operate in a waterfall mode (see, for instance, U.S. Pat. No. 4,881,280) or in a fountain mode (see, for instance, U.S. Pat. Nos. 3,318,528; 3,831,852; 4,174,808; and 4,936,506). However, none of these devices is adapted to operate in both a waterfall mode and a fountain mode.

SUMMARY OF THE INVENTION

The present invention benefits from the advantages of both the waterfall and fountain devices discussed above by providing a new and improved device which is specifically designed to create a waterfall effect and a fountain effect in an adjacent body of water, such as a swimming pool, spa or the like. More particularly, the new and improved device includes spraying means, such as a tubular manifold with a plurality of spray orifices arranged along the length thereof, which is movably mounted on a housing. In one position relative to the housing, the spraying means sprays water externally of the housing and into the adjacent body of water in the form of a spray, thereby creating a fountain effect. In another position relative to the housing, the spraying means sprays water internally of the housing in such a manner that the water is collected in a receiving means, such as a reservoir, within the housing. The receiving means includes discharging means, such as a lip or outlet, adapted to discharge water from the receiving means and into the adjacent body of water in the form of a smooth sheet, thereby creating a waterfall effect.

The device may also be equipped with controlling means for selectively controlling the position of the spraying means relative to the housing, whereby the device can be switched from a waterfall mode of operation to a fountain mode of operation and vice versa. If, for instance, the controlling means is in the form of a manually operable knob or handle, the position of the spraying means can be varied by simply gripping the knob or handle and rotating it relative to the housing.

By allowing the position of the spraying means to be varied when the device is operating in a fountain mode, the device has the capability of producing a number of different spray patterns. The spray pattern could also be changed by regulating the amount of water supplied to the spraying means. Such regulation of the water supply to the spraying means can, for instance, be achieved by connecting the device to a return line of a swimming pool filtration system using a diverter valve adapted to regulate the percentage of the water diverted from the return line to the device and hence to the spraying means.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention can be used in many different applications where a waterfall and/or fountain effect are to be created in an adjacent body of water, such as natural or man-made pools, spas and the like, it is especially suitable for use in connection with recreational swimming pools. Accordingly, the present invention will be described in connection with two different swimming pool installations.

Figure 1:
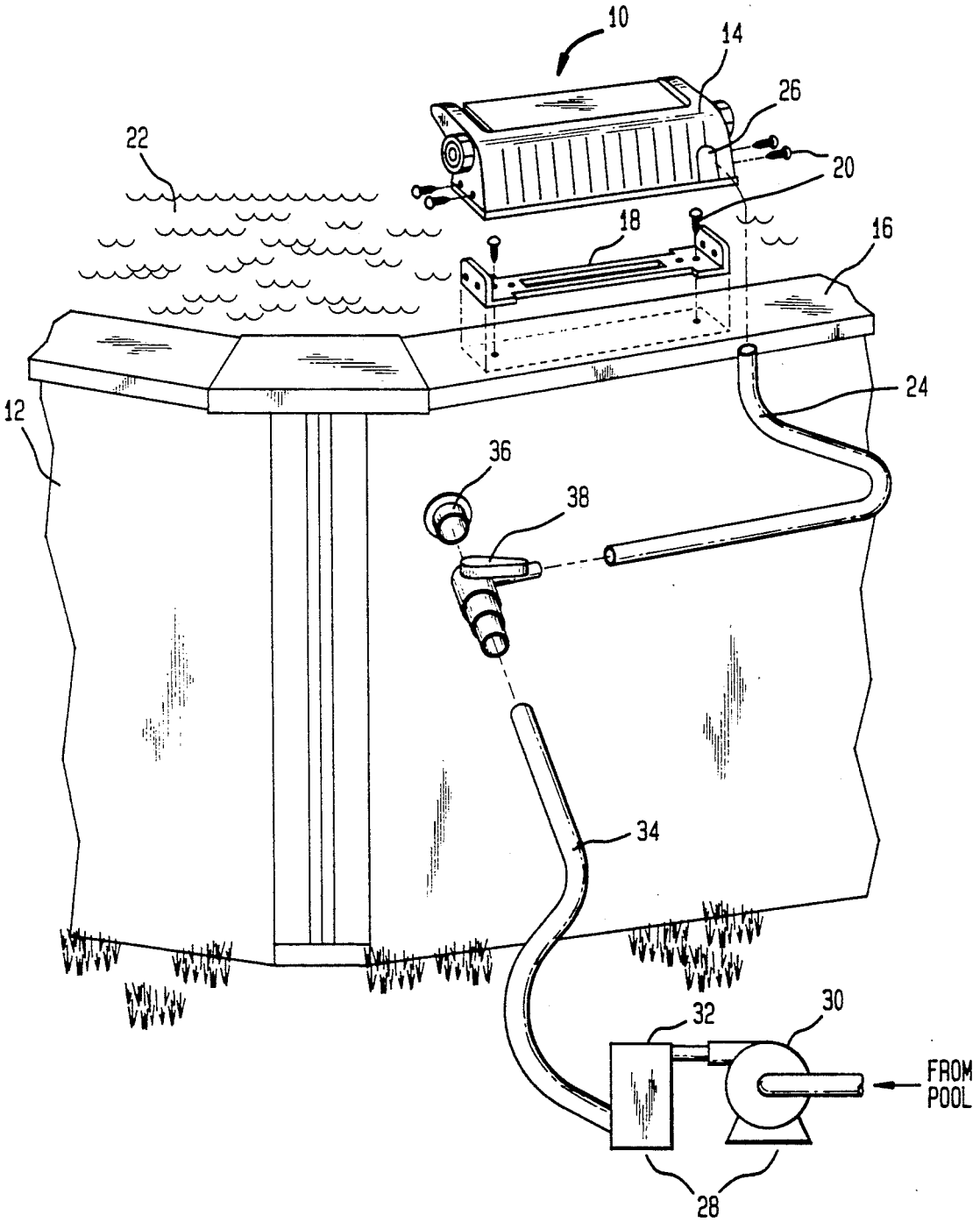
FIG. 1 is a perspective view of an above-ground swimming pool installation equipped with a waterfall-/fountain device constructed in accordance with one exemplary embodiment of the present invention, the waterfall/fountain device being shown in a partially exploded fashion to facilitate consideration and discussion.
Figure 2:
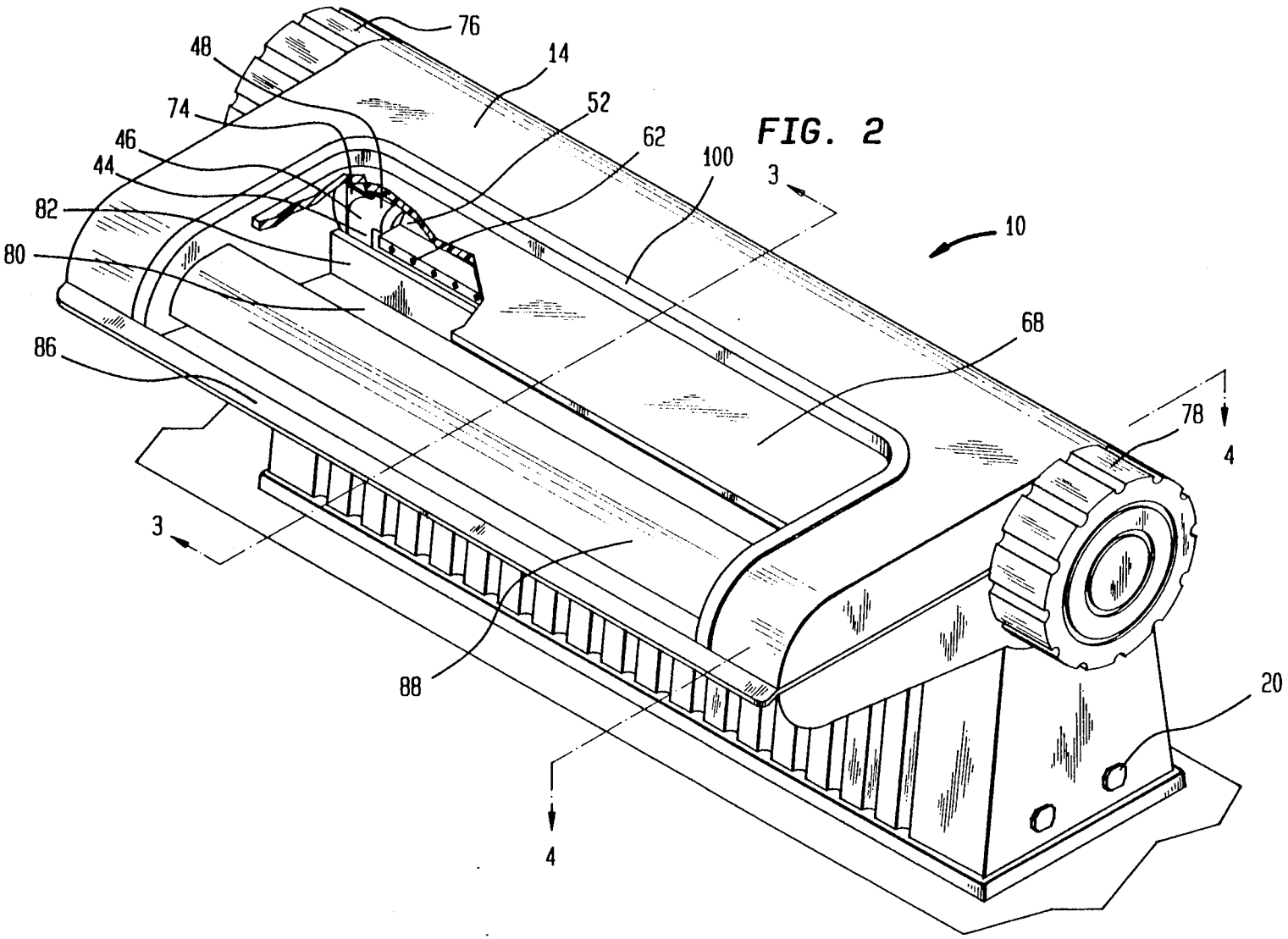
FIG. 2 is a front perspective view of the waterfall-/fountain device of FIG. 1 configured to operate in a waterfall mode, a portion of the waterfall/fountain device being broken away to facilitate consideration and discussion.
Figure 3:
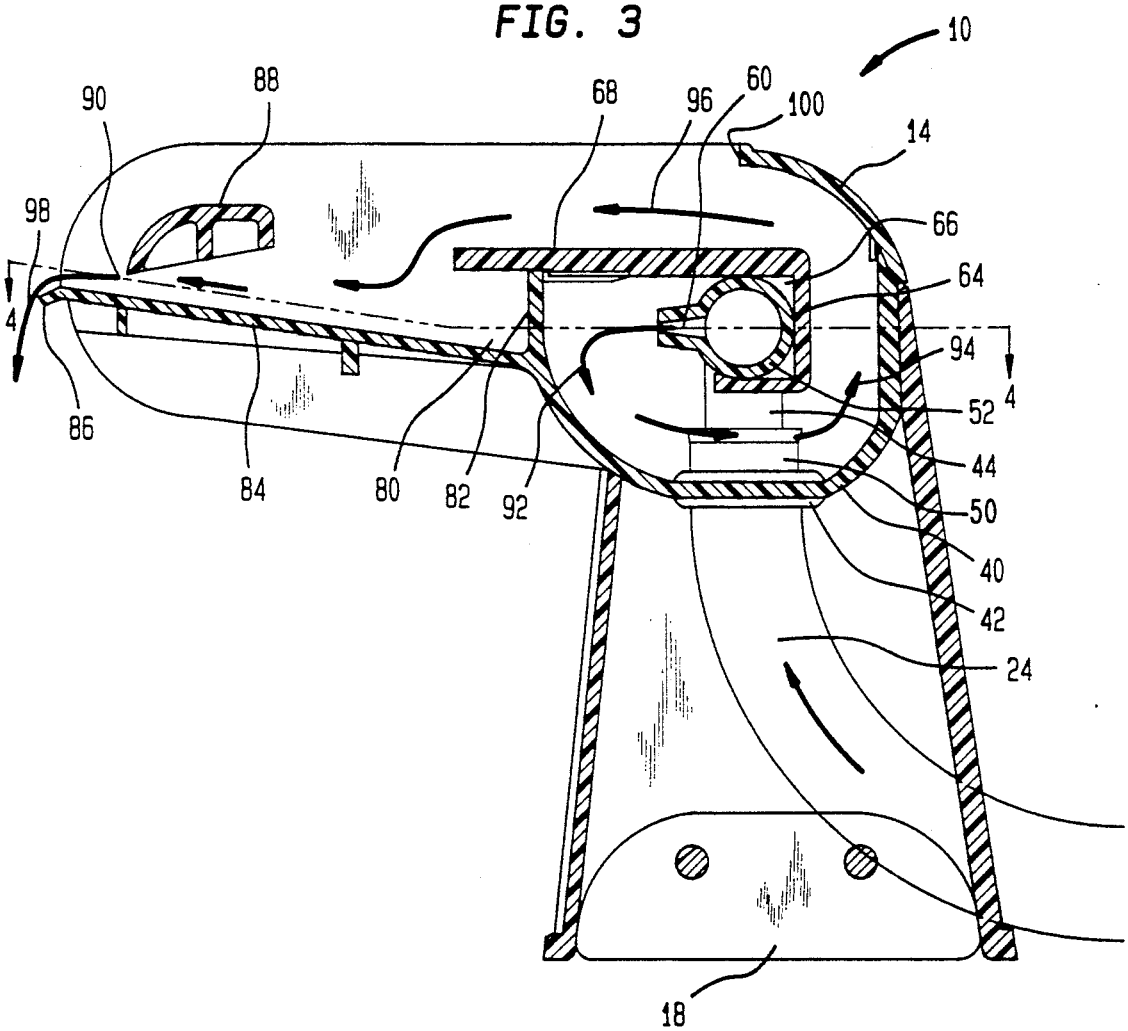
FIG. 3 is a cross-sectional view, taken along section line 3—3 in FIG. 2 and looking in the direction of the arrows, of the waterfall/fountain device illustrated in FIG. 2.
Figure 4:
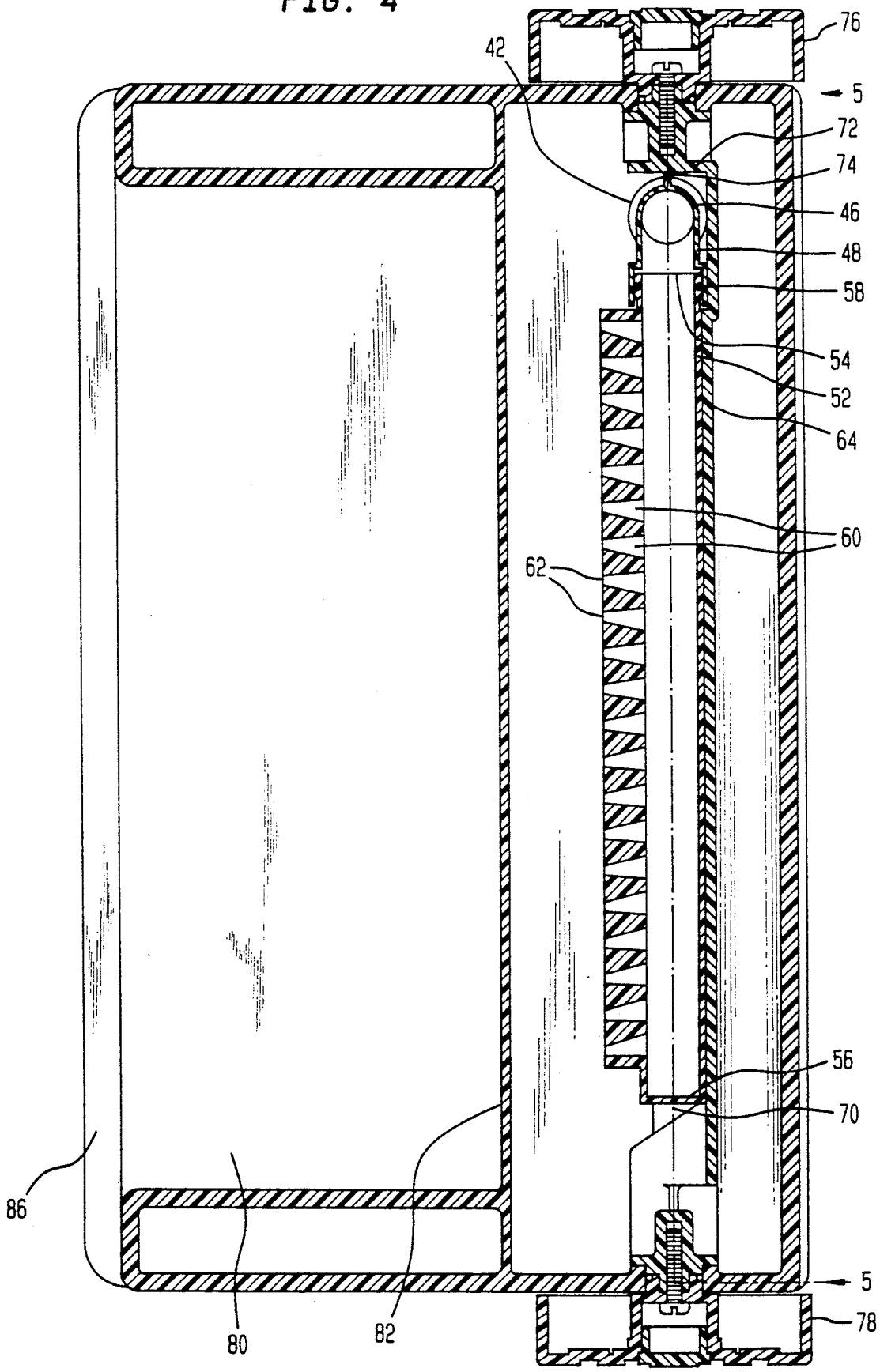
FIG. 4 is a cross-sectional view, taken along section line 4—4 in FIG. 3 and looking in the direction of the arrows, of the waterfall/fountain device illustrated in FIG. 3.
Figure 5:
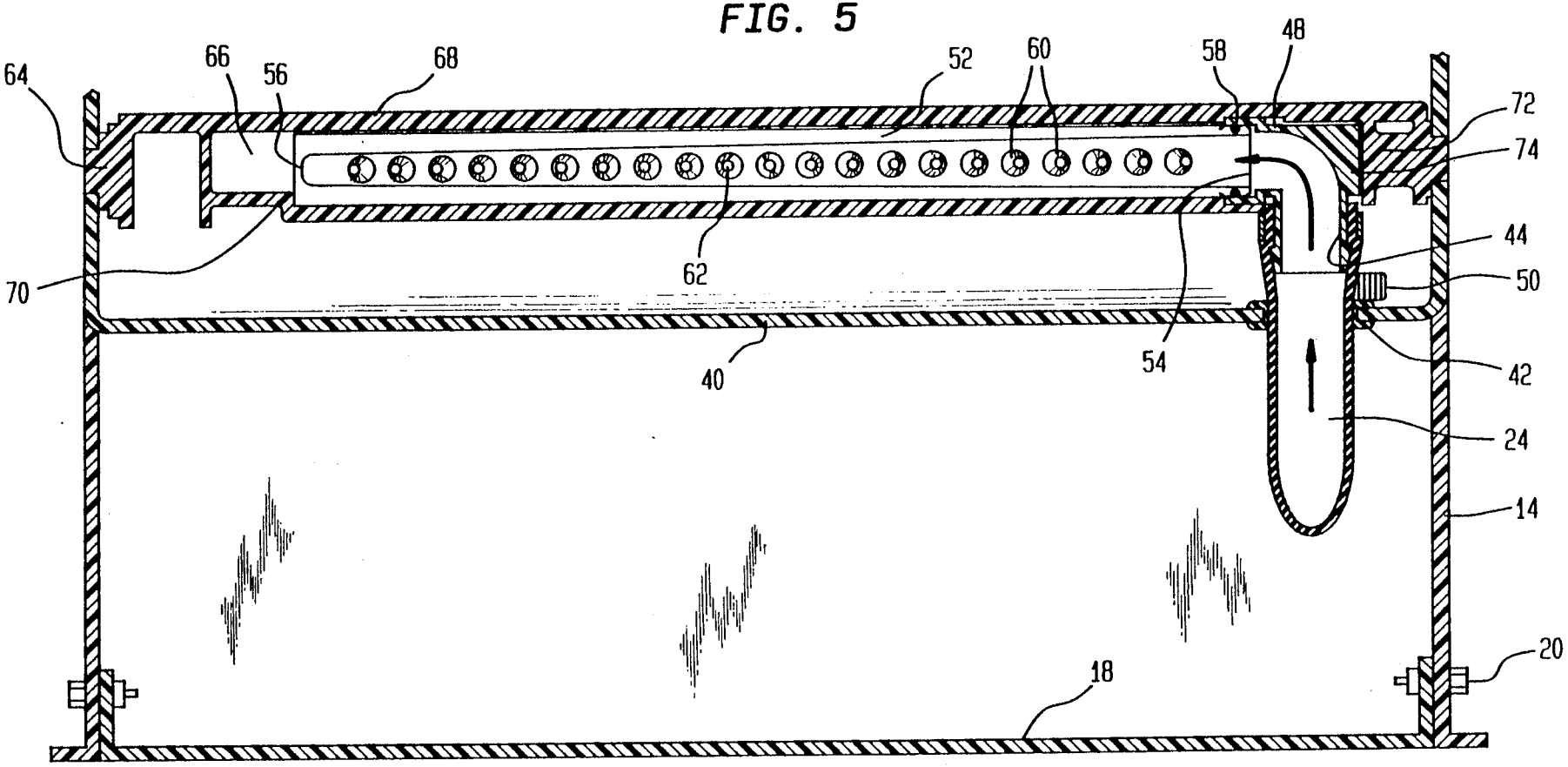
FIG. 5 is a cross-sectional view, taken along section line 5—5 in FIG. 4 and looking in the direction of the arrows, of the waterfall/fountain device illustrated in FIG. 4.

Referring to FIG. 1, a waterfall/fountain device 10 is shown in combination with an above-ground pool installation 12. The waterfall/fountain device 10 includes a housing 14 that mounts flush against coping 16 of the pool installation 12 through the use of a bracket 18. The bracket 18 is affixed to both the coping 16 and to the housing 14 by the use of mechanical fasteners 20. A supply hose 24 extends into the housing 14. A slot 26 is formed in the housing 14 to allow the supply hose 24 to pass into the housing 14 without disrupting the flush mounting of the housing 14 on the coping 16.

The pool installation 12 is provided with a filtration system 28 which typically includes a pump 30 adapted to draw pool water 22 from the pool 12 and discharge the pool water 2 through a filter 32. Filtered water is discharged back into the pool installation 12, from the filter 32, through a return line 34. The return line 34 normally discharges filtered water back into the pool installation 12 through an outlet fitting 36. However, a three-way valve 38 diverts and regulates a variable amount of the filtered water into the supply hose 24 and ultimately up through the waterfall/fountain device 10.

Referring now to FIGS. 2–7, the supply hose 24 passes into the housing 14 until it transgresses through the bottom of trough 40. A water-tight grommet 42 surrounds the supply hose 24 as it passes into the trough 40, ensuring that no water can flow between the supply hose 24 and the trough 40. The supply hose 24 is press fit onto vertical leg 44 of elbow 46. The connection of the supply hose 24 to the vertical leg 44 is reinforced by a clamp 50 that prevents the supply hose 24 from being pulled down through the grommet 42 and away from the elbow 46.

The elbow 46 also has a horizontal leg 48 that is removably connected to a manifold 52 located within the trough 40. The manifold 52 has an open end 54 and a closed end 56. The elbow 46 acts to direct fluid flowing through the supply hose 24 into the open end 54 of the manifold 52, filling a hollow interior of the manifold 52. The manifold 52 has a annular groove formed near its open end 54 to hold a resilient 0-ring 58, which creates a water-tight seal between the interior surface of the horizontal leg 48 of the elbow 44 and the exterior surface of the open end 54 of the manifold 52. The O-ring 58 also allows the manifold 52 to be rotated relative to the elbow 44 without compromising the integrity of the seal formed by the O-ring 58. The removability of the manifold 52 facilitates the replacement of the O-ring 58, as well as the cleaning and replacement of the manifold 52 itself.

The hollow interior of the manifold 52 is tapered down toward the closed end 56. A plurality of exit ports 60 are evenly spaced along the length of the manifold 52 in communication with its hollow interior. Each of the exit ports 60 is tapered to a narrow spray orifice 62 and has a predetermined orientation designed to achieve a fan-like spray pattern (see FIG. 7).

A holding member 64 forms a channel 66 that releasably receives the manifold 52 and holds the manifold 52 in place within the trough 40. One edge of the channel 66 is elongated, forming a flap 68 and giving the holding member 64 a J-shaped cross section. A stop 70 is formed within the channel 66 at one end of the holding member 64. The stop 70 contacts the closed end 56 of the manifold 52 and prevents the manifold 52 from moving laterally within the channel 66. Similarly, a tab 72, which extends from an opposite end of the holding member 64, is in abutment with a ridge 74 formed on the elbow 46, preventing the elbow 46 from rocking or otherwise moving out of engagement with the manifold 52. Thus, the stop 70 and the tab 72 act in combination to ensure that the manifold 52 and the elbow 46 are not inadvertently disengaged from one another.

The holding member 64 is pivotally connected at its ends, to the housing 14 by knob and axle assemblies 76, 78. The knob and axle assembles 76, 78 facilitate the rotation of the holding member 64, and hence the manifold 52, along a predetermined arc.

A reservoir 80 is formed in the housing 14 adjacent to the trough 40. A baffle 82 separates the reservoir 80 from the trough 40. The capacity of the reservoir 80 is dictated by the height of the baffle 82 and the width, length and slope of a floor 84 of the reservoir 80. The end of the reservoir 80 opposite the baffle 82 terminates in an lip 86. A flow stabilizer 88 is suspended above the reservoir 80 creating a narrow throat 90 between the reservoir floor 84 and the flow stabilizer 88.

The waterfall mode of operation of the device 10 will now be described with reference to FIGS. 2–5. Filtered water enters the housing 14 through the supply hose 24. The water in the supply hose 24 travels through the trough 40 and into the elbow 46. The elbow 46 directs the water into the hollow interior of the manifold 52, which is tapered so as to equalize the pressure of the water across all of the exit ports 60. As the water flows through the exit ports 60 and out the spray orifices 62, the pressure of the water increases and the water exits the spray orifices 62 at an increased velocity.

In the waterfall mode, the holding member 64 is rotated until the flap 68 contacts the baffle 82. In this position, the manifold 52 is oriented so that water exiting through the spray orifices 62 strikes the baffle 82. The water striking the baffle 82 is prevented from splashing over the top of the baffle 82 by the presence of the flap 68 of the holding member 64. Consequently, the water exiting the manifold 52 is forced down into the trough 40 (see arrow 92). As the trough 40 eventually fills with water, the water flows up behind the manifold 52 and over the top of the flap 68 (see arrow 94). The flap 68 acts as a bridge, allowing water to flow over the baffle 82 and into the reservoir 80 (see arrow 96). The reservoir 80 fills with water until the water is high enough to flow over the lip 86 in the form of a smooth sheet (see arrow 98) to thereby create the desired waterfall effect. Because the lip 86 is angled, the water flowing over the lip 86 is directed away from the housing 14. This prevents water from adhering to the housing 14 and dripping down its face, disrupting the smoothness of the waterfall flow.

The aesthetics of the waterfall flow are also enhanced by the flow stabilizer 88. The flow stabilizer 88 skims the top of the water contained in the reservoir 80, thereby suppressing any turbulence in the water caused by the flow of the water into the reservoir 80 from the trough 40. Consequently, any unevenness in the water is eliminated, and the water that does pass through the throat 96 is uniform and smooth.

Figure 6:
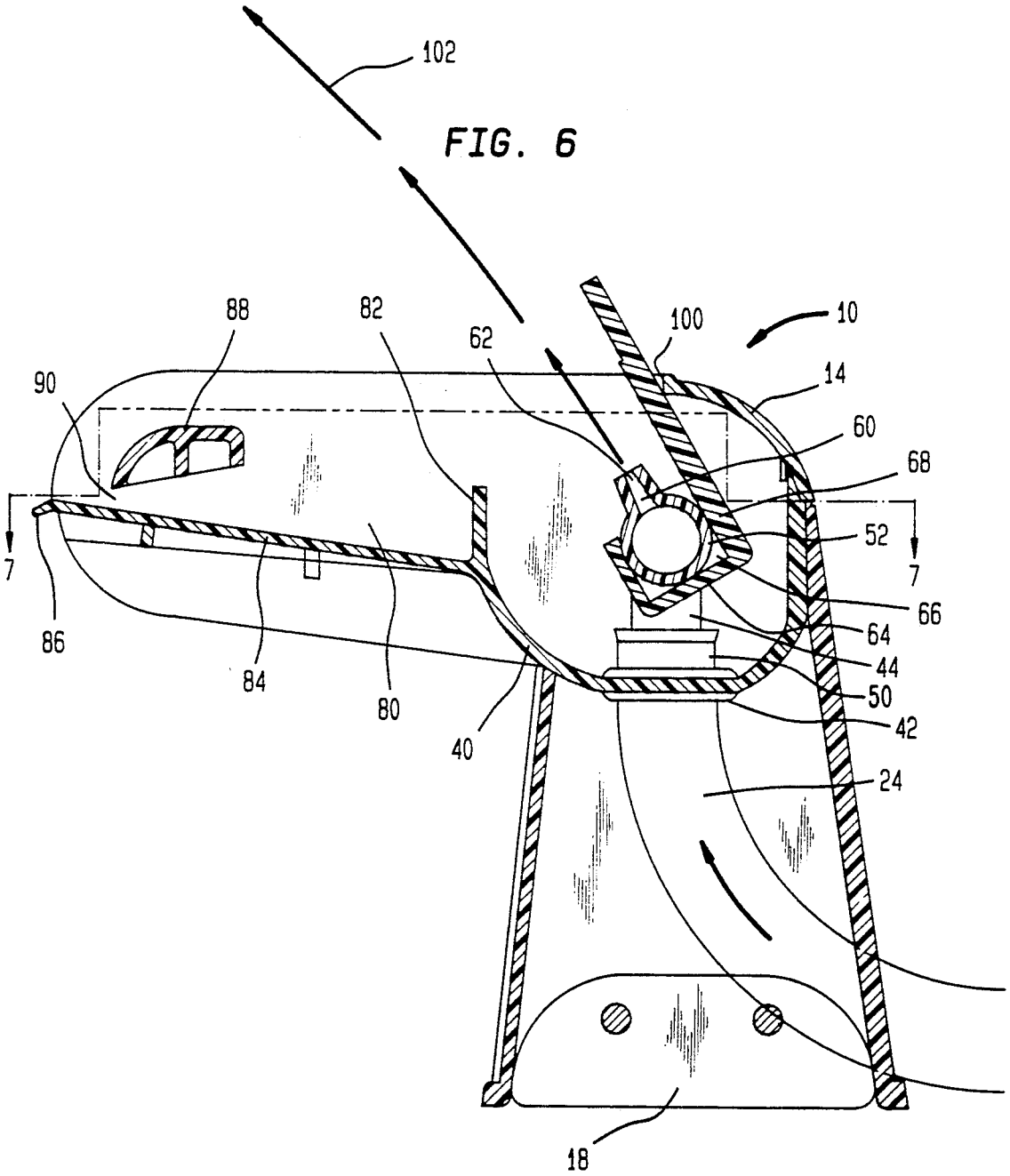
FIG. 6 is a cross-sectional view similar to that of FIG. 3, except that the waterfall/fountain device is configured to operate in a fountain mode.
Figure 7:
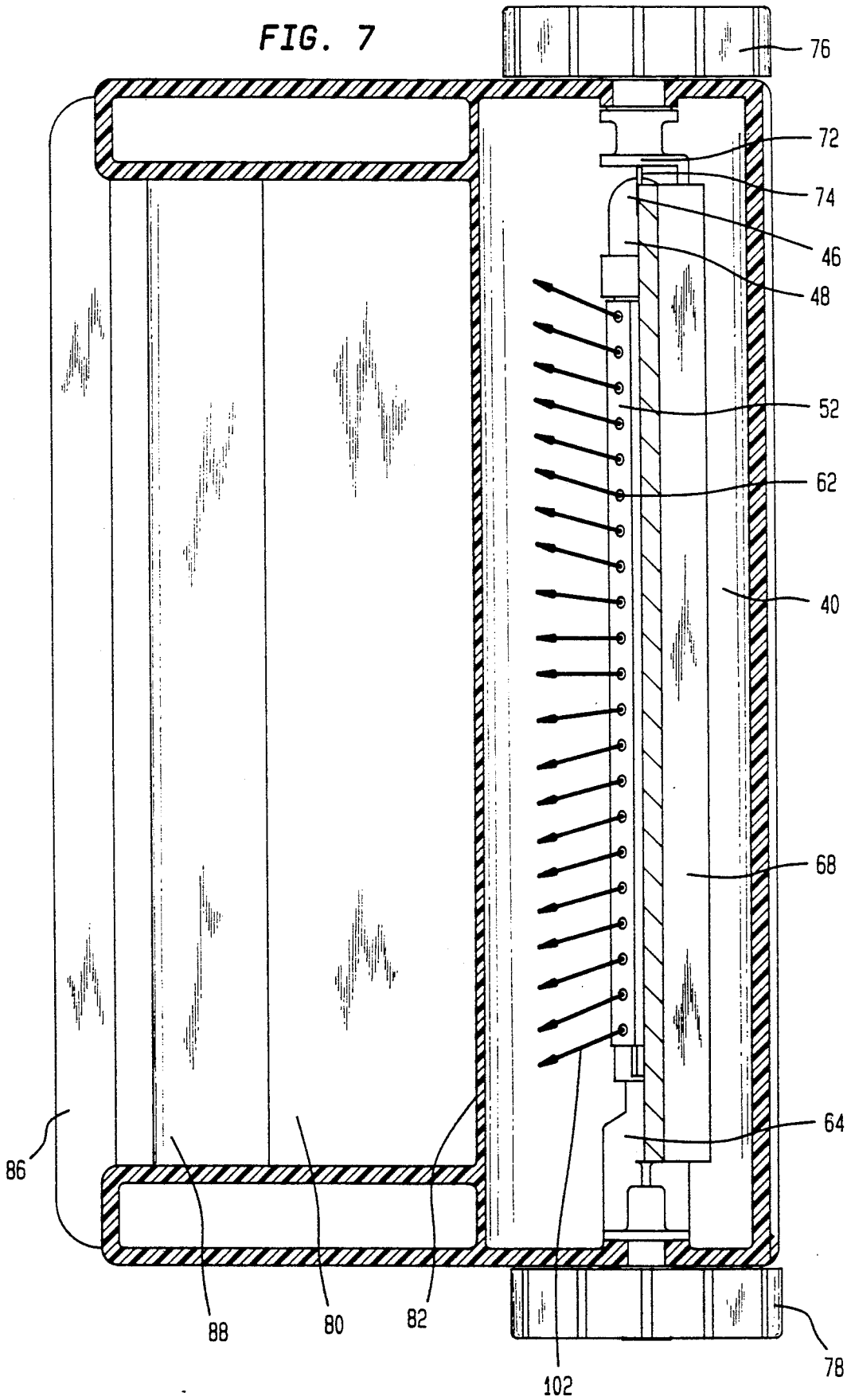
FIG. 7 is a cross-sectional view, taken along section line 7—7 in FIG. 6 and looking in the direction of the arrows, of the waterfall/fountain device illustrated in FIG. 6.

The fountain mode of operation of the device 10 will now be described with reference to FIGS. 6 and 7. Filtered water enters and exits the manifold 52 in the same manner as previously described in connection with the waterfall mode of operation. However, in the fountain mode, the manifold 52 has been rotated so that the flap 68 contacts the top edging 100 of the housing 14 and, as a result, the water exiting the spray orifices 62 does not contact the baffle 82. When the water exiting the spray orifices 62 no longer contacts the baffle 82, the pressure and the exit velocity of the water cause the water to be propelled into the air as streams of water (see arrow 102) which cooperate to form a fan-like (i.e., diverging) spray pattern. Of course, it should be understood that the spray orifices 60 can be oriented so that the streams of water are parallel, converge or follow any predetermined pattern.

The angle at which the streams of water are projected from the housing 14 can be adjusted by rotating the manifold 52. The highest trajectory or greatest angle occurs when the manifold 52 is rotated until the flap 68 of the holding member 64 contacts the top edging 100 of the housing 14, The angle can be lowered until the water exiting the manifold 52 is obstructed by the baffle 82. The trajectory of the streams can also be varied by using the three-way valve 38 to regulate the flow of water into the manifold 56. Thus, by adjusting the three-way valve 38 and/or the angular position of the manifold 52, numerous different spray patterns can be achieved.

Figure 8:
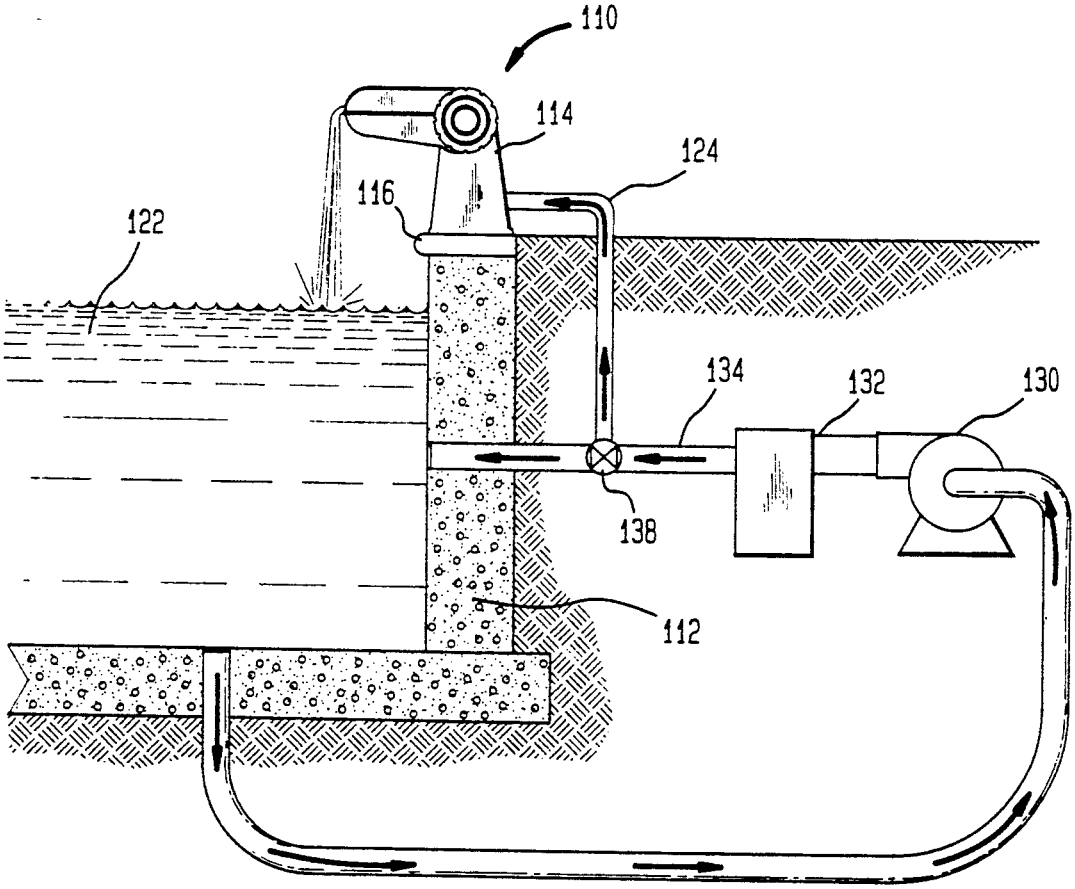
FIG. 8 is a schematic illustration showing an in-ground swimming pool installation equipped with the waterfall/fountain device of FIGS. 1-7.

Another swimming pool installation adapted for use in combination with the present invention is illustrated in FIG. 8. Elements illustrated in FIG. 8 which correspond to the elements described above with respect to FIGS. 1–7 have been designated by corresponding reference numerals increased by a hundred. The installation shown in FIG. 8 operates in the same manner as the installation of FIG. 1–7 unless otherwise stated.

Referring now to FIG. 8, a waterfall/fountain device 110 is shown in combination with an in-ground pool installation 112. The device is shown in its waterfall mode and includes a housing 114, which is attached to a coping 116 at ground level. Because the coping 116 is typically made of cement or tile, it should be understood that the housing 114 could utilize an adhesive or mortar-based sealant for attachment, eliminating any damage to the coping 116 caused by a mechanical fastener. The pool installation 112 is below ground level, having a pump 130, filter 132, and return line 134. Because of the in-ground installation, it is possible that a three-way valve 138 employed to divert water from the return line 134 to a supply hose 124 of the device 110 would also be below ground. Thus, it should be understood that the valve 138 would have to be electrically or remotely operated.

It will be understood that the embodiment described herein is merely exemplary and that a person skilled in the art may make variations and modifications without departing from the spirit and scope of the invention. All such variations and modifications are intended to be included within the scope of the invention as defined in the appended claims.

What is claimed is:

1. A device for creating waterfall and fountain effects in an adjacent body of water, comprising a housing; spraying means for spraying water therefrom, said spraying means being mounted on said housing and being movable relative to said housing between a first position in which said spraying means sprays water externally of said housing and into the adjacent body of water in the form of a spray, thereby creating a fountain effect, and a second position in which said spraying means sprays water internally of said housing; and receiving means within said housing for receiving water sprayed internally of said housing by said spraying means when said spraying means is in its said second position, said receiving means including discharging means for discharging water from said receiving means and into the adjacent body of water in the form of a smooth sheet, thereby creating a waterfall effect.

2. A device according to claim 1, further comprising controlling means, mounted on said housing and attached to said spraying means, for selectively controlling the position of said spraying means relative to said housing.

3. A device according to claim 2, wherein said controlling means includes at least one manually positionable knob.

4. A device according to claim 1, further comprising flow directing means for directing water sprayed into said receiving means by said spraying means when said spraying means is in its said second position.

5. A device according to claim 4, wherein said spraying means is a manifold having at least one exit port formed therein, said exit port being sized and shaped to emit a stream of water from said manifold.

6. A device according to claim 5, wherein said manifold has a plurality of exit ports formed therein, each exit port being sized and shaped to emit a stream of water from said manifold.

7. A device according to claim 6, wherein said exit ports diverge from each other in a fan-like pattern.

8. A device according to claim 5, further comprising holding means for releasably holding said manifold, said holding means including a flap that extends beyond said manifold.

9. A device according to claim 8, wherein said flap forms a part of said flow directing means when said spraying means is in its said second position.

10. A device according to claim 9, wherein said flow directing means includes a trough positioned to receive water sprayed internally of said housing by said spraying means, when said spraying means is in its said second position, and to supply water to said receiving means.

11. A device according to claim 1, wherein water sprayed externally of said housing by said spraying means, when said spraying means is in its said first position, is projected at an inclined angle relative to said housing.

12. A device according to claim 11, wherein said inclined angle is adjustable across a predetermined range while said spraying means is in its said first position.

13. A device according to claim 1, wherein said receiving means has a predetermined capacity, whereby water supplied to said receiving means in excess of said capacity is discharged from said receiving means by said discharging means.

14. A device according to claim 13, wherein said discharging means includes a lip over which any water within said receiving means, in excess of said capacity, will flow.

15. A device according to claim 14, further comprising flow restricting means for restricting the height of the water flowing over said lip.

16. A device of claim 14, wherein said lip is angled away from said housing to thereby prevent water from adhering to said housing as it flows over said lip.

17. In combination: a water circulation system for a swimming pool, said water circulation system including circulating means for circulating water from a swimming pool to a filter and back to the pool through a return line; a device for creating waterfall and fountain effects in the swimming pool, said device including a housing, spraying means for spraying water therefrom, said spraying means being mounted on said housing and being movable relative to said housing between a first position in which said spraying means sprays water externally of said housing and into the swimming pool in the form of a spray, thereby creating a fountain effect, and a second position in which said spraying means sprays water internally of said housing, and receiving means within said housing for receiving water sprayed internally of said housing by said spraying means when said spraying means is in its said second position, said receiving means including discharging means for discharging water from said receiving means and into the swimming pool in the form of a smooth sheet, thereby creating a waterfall effect; and a diverting means for diverting water from said return line to said spraying means.

18. A combination according to claim 17, wherein said diverting means includes an adjustable valve.

19. A combination according to claim 17, wherein said device further includes controlling means, mounted on said housing and attached to said spraying means, for selectively controlling position of said spraying means relative to said housing.

20. A combination according to claim 19, wherein said controlling means includes at least one manually positionable knob.

21. A combination according to claim 17, wherein said device further includes flow directing means for directing water sprayed into said receiving means by said spraying means when said spraying means is in its said second position.

22. A combination according to claim 21, wherein said spraying means is a manifold having at least one exit port formed therein, said exit port being sized and shaped to emit a stream of water from said manifold.

23. A combination according to claim 22, wherein said manifold has a plurality of exit ports formed therein, each exit port being sized and shaped to emit a stream of water from said manifold.

24. A combination according to claim 23, wherein said exit ports diverge from each other in a fan-like pattern.

25. A combination according to claim 22, further comprising holding means for releasably holding said manifold, said holding means including a flap that extends beyond said manifold.

26. A combination according to claim 25, wherein said flap forms a part of said flow directing means when said spraying means is in its said second position.

27. A combination according to claim 26, wherein said flow directing means includes a trough positioned to receive water sprayed internally of said housing by said spraying means, when said spraying means is in its said second position, and to supply water to said receiving means.

28. A combination according to claim 17, wherein water sprayed externally of said housing by said spraying means, when said spraying means is in its said first position, is projected at an inclined angle relative to said housing.

29. A combination according to claim 28, wherein said inclined angle is adjustable across a predetermined range while said spraying means is in its said first position.

30. A combination according to claim 17, wherein said receiving means of said device has a predetermined capacity, whereby water supplied to said receiving means in excess of said capacity is discharged from said receiving means by said discharging means.

31. A combination according to claim 30, wherein said discharging means includes a lip over which any water within said receiving means, in excess of said capacity, will flow.

32. A combination according to claim 31, further comprising flow restricting means for restricting the height of the water flowing over said lip.

33. A combination of claim 31, wherein said lip is angled away from said housing to thereby prevent water from adhering to said housing as it flows over said lip.

* * * * *